US011211699B2

(12) United States Patent
Qu

(10) Patent No.: US 11,211,699 B2
(45) Date of Patent: Dec. 28, 2021

(54) ANTENNA SYSTEM AND TERMINAL

(71) Applicant: ZTE CORPORATION, Guangdong (CN)

(72) Inventor: Sanlang Qu, Guangdong (CN)

(73) Assignee: ZTE CORPORATION, Shenzhen (CN)

( * ) Notice: Subject to any disclaimer, the term of this patent is extended or adjusted under 35 U.S.C. 154(b) by 106 days.

(21) Appl. No.: 16/648,400

(22) PCT Filed: Sep. 25, 2018

(86) PCT No.: PCT/CN2018/107281

§ 371 (c)(1),
(2) Date: Mar. 18, 2020

(87) PCT Pub. No.: WO2019/057195

PCT Pub. Date: Mar. 28, 2019

(65) Prior Publication Data

US 2020/0259254 A1 Aug. 13, 2020

(30) Foreign Application Priority Data

Sep. 25, 2017 (CN) ..... 201710874956.8

(51) Int. Cl.
*H01Q 1/52* (2006.01)
*H01Q 21/06* (2006.01)

(52) U.S. Cl.
CPC ..... *H01Q 1/523* (2013.01); *H01Q 1/52* (2013.01); *H01Q 1/521* (2013.01); *H01Q 21/06* (2013.01)

(58) Field of Classification Search
CPC ..... H01Q 1/52; H01Q 1/521; H01Q 1/523; H01Q 1/525; H01Q 21/00; H01Q 21/06
See application file for complete search history.

(56) References Cited

U.S. PATENT DOCUMENTS 9,762,710 B2 9/2017 Lee et al.
10,581,155 B1 * 3/2020 Gradinaru ..... H04B 1/109
(Continued)

FOREIGN PATENT DOCUMENTS

CN 104124526 A 10/2014
CN 104577332 A 4/2015
(Continued)

OTHER PUBLICATIONS

WIPO, International Search Report dated Dec. 5, 2018.
China Patent Office, First Office Action dated Dec. 2, 2020 for application No. CN201710874956.8.

*Primary Examiner* — Seokjin Kim
(74) *Attorney, Agent, or Firm* — Cantor Colburn LLP

(57) ABSTRACT

The present disclosure provides an antenna system and a terminal. The antenna system includes a plurality of antennas; an isolation degree control module connected to the plurality of antennas, respectively; and a processor connected to the isolation degree control module. The processor is configured to determine, among the plurality of antennas, two target antennas needing optimization control of isolation degree, and control, according to the two target antennas and operating frequency bands respectively corresponding to the two target antennas, the isolation degree control module to perform the optimization control of isolation degree between the two target antennas.

20 Claims, 3 Drawing Sheets

(56) References Cited

U.S. PATENT DOCUMENTS

| | | | | |
|---|---|---|---|---|
| 11,088,909 | B2 * | 8/2021 | Hou | H04L 41/0816 |
| 2012/0105296 | A1 | 5/2012 | Chung et al. | |
| 2014/0320372 | A1 * | 10/2014 | Wu | H01Q 1/521 343/853 |
| 2015/0200646 | A1 * | 7/2015 | Peng | H03H 11/28 455/77 |
| 2015/0222316 | A1 * | 8/2015 | Ibrahim | H04B 1/401 455/78 |
| 2016/0180125 | A1 * | 6/2016 | Schuster | H01Q 1/2216 235/451 |
| 2018/0159563 | A1 * | 6/2018 | Khlat | H01Q 5/50 |
| 2019/0229416 | A1 | 7/2019 | Gao et al. | |
| 2020/0259254 | A1 * | 8/2020 | Qu | H01Q 21/00 |

FOREIGN PATENT DOCUMENTS

| | | | | |
|---|---|---|---|---|
| CN | 204375977 | U | 6/2015 | |
| CN | 105789887 | A | 7/2016 | |
| CN | 106230569 | A | 12/2016 | |
| CN | 106450662 | A | 2/2017 | |
| CN | 106571525 | A | 4/2017 | |
| CN | 106785370 | A | 5/2017 | |
| EP | 3188309 | A1 * | 7/2017 | H01Q 1/521 |
| WO | 2016115697 | A1 | 7/2016 | |

* cited by examiner

ANTENNA SYSTEM AND TERMINAL

This is a National Phase Application filed under 35 U.S.C 371 as a national state of PCT/CN2018/107281, filed on Sep. 25, 2018, an application claiming the priority of Chinese Patent Application No. 201710874956.8, filed on Sep. 25, 2017, the contents of which are incorporated herein in their entirety by reference.

TECHNICAL FIELD

The present disclosure relates to the field of antennas, and in particular, to an antenna system and a terminal.

BACKGROUND

With development of the times, requirements for antennas are higher and higher, and a problem about an isolation degree that could have been solved by means of spatial distance has become particularly prominent. In some cases, in order to improve an isolation degree between two fixed antennas, an isolation ground wall may be provided between two antennas or an isolation device of a fixed frequency band may be provided.

However, the solution of providing the isolation wall between the two antennas requires a lot of simulation and experiment in an initial design stage, which results in a longer design cycle and higher design cost, which adversely affects the overall project schedule. In addition, the providing of the isolation device with the fixed frequency band can only satisfy an improvement of an isolation degree between two fixed antennas, and if isolation degrees between all antennas are wanted to be improved, a large number of devices are needed, which is even more detrimental to the already tight layout area.

SUMMARY

The present disclosure provides an antenna system including: a plurality of antennas; an isolation degree control module connected to the plurality of antennas, respectively; and a processor connected to the isolation degree control module, where the processor is configured to determine, among the plurality of antennas, two target antennas needing optimization control of isolation degree, and control, according to the two target antennas and operating frequency bands respectively corresponding to the two target antennas, the isolation degree control module to perform the optimization control of isolation degree between the two target antennas.

According to another aspect of the embodiments of the present disclosure, a terminal including the antenna system above is provided.

DETAILED DESCRIPTION

The following detailed description is made with reference to the accompanying drawings and specific embodiments to make the technical problems to be solved, technical solutions and advantages clearer. In the following description, specific details are provided, such as specific configurations and components, merely to facilitate a thorough understanding of embodiments of the present disclosure. Accordingly, it will be apparent to those skilled in the art that various changes and modifications can be made to the embodiments described herein without departing from the scope and spirit of the present disclosure. In addition, descriptions of well-known functions and constructions are omitted for clarity and conciseness.

Figure 1:
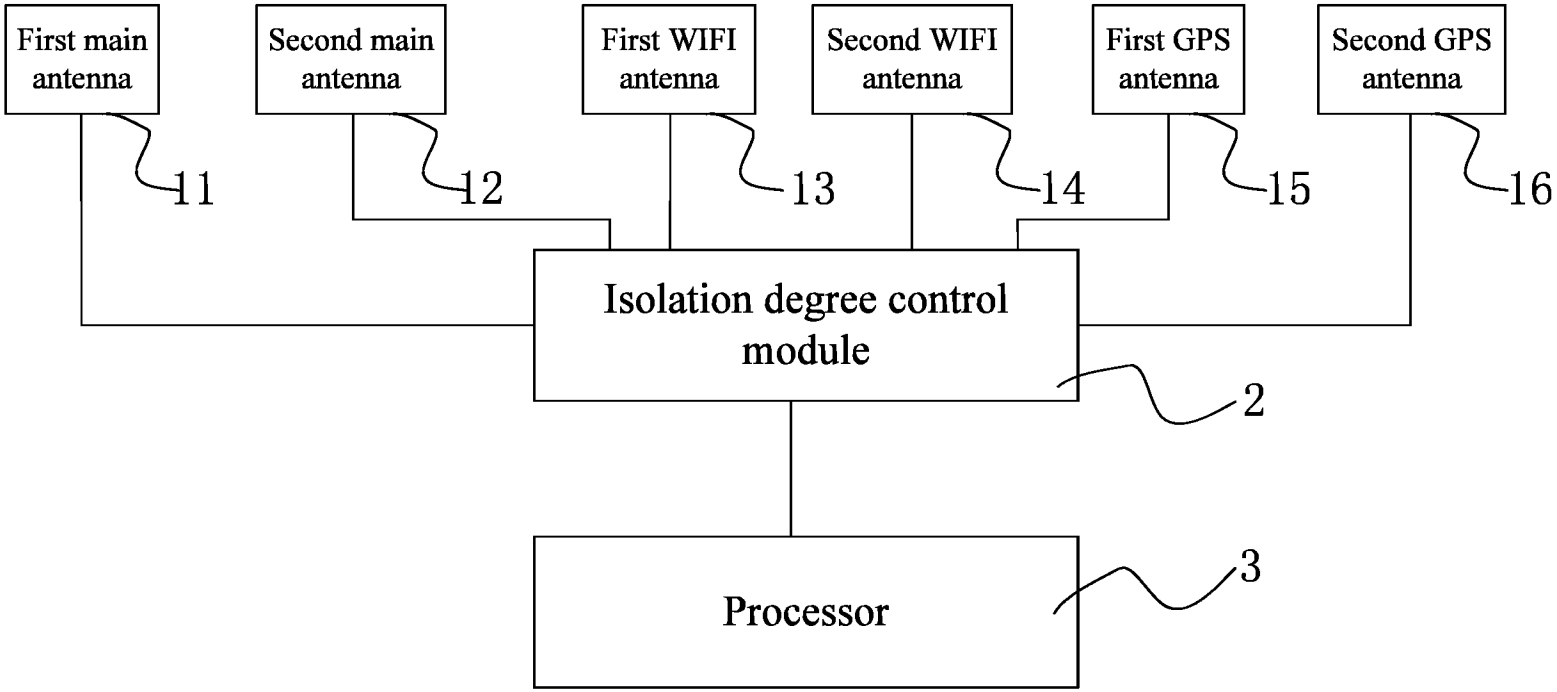
FIG. 1 is a schematic structural diagram of an antenna system according to an embodiment of the present disclosure.
Figure 2:
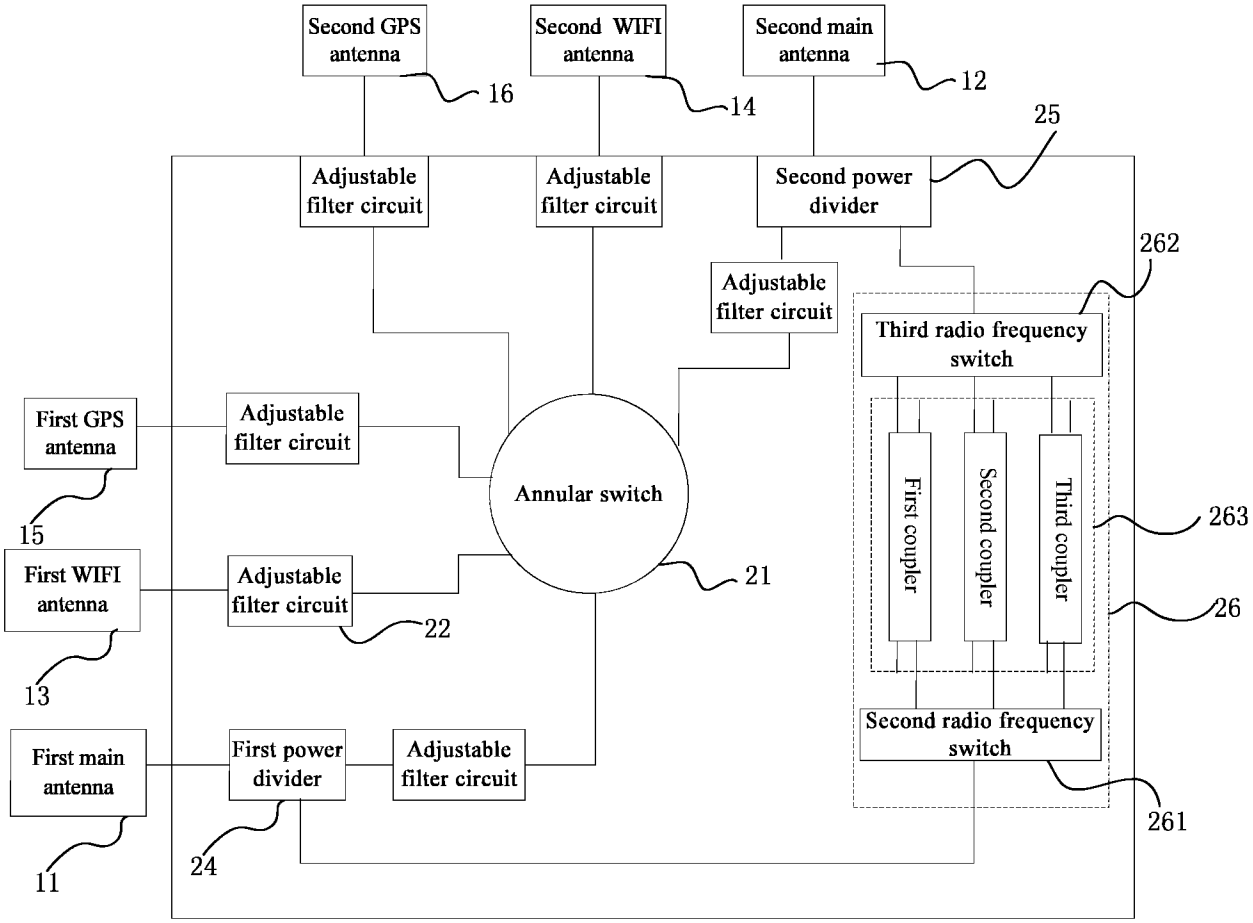
FIG. 2 is a schematic diagram of a connection structure between an isolation degree control module and antennas according to an embodiment of the present disclosure.
Figure 3:
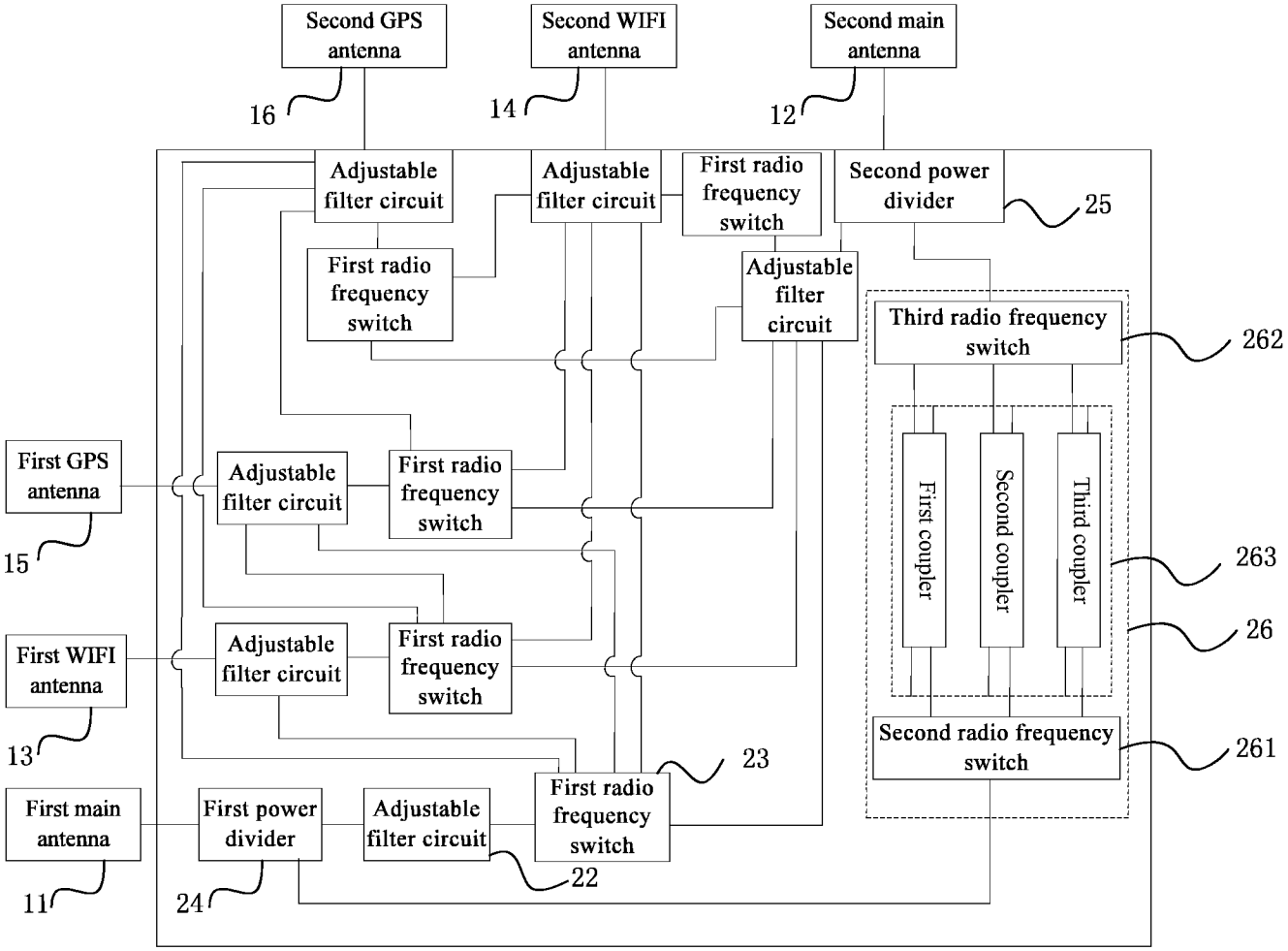
FIG. 3 is a schematic diagram of another connection structure between an isolation degree control module and antennas according to an embodiment of the present disclosure.

Referring to FIGS. 1 to 3, the present disclosure provides an antenna system, including: a plurality of antennas; an isolation degree control module 2 connected to the plurality of antennas, respectively; and a processor 3 connected to the isolation degree control module 2. The processor 3 is configured to determine, among the plurality of antennas, two target antennas needing optimization control of isolation degree, and control, according to the two target antennas and operating frequency bands respectively corresponding to the two target antennas, the isolation degree control module 2 to perform the optimization control of isolation degree between the two target antennas.

The processor 3 of the present disclosure is a central processing unit (CPU) included in a terminal.

Specifically, as shown in FIGS. 1 to 3, the plurality of antennas may include: a main antenna, a Wireless Fidelity (WIFI) antenna, and a Global Positioning System (GPS) antenna. The main antenna may include a first main antenna 11 and a second main antenna 12, the WIFI antenna may include a first WIFI antenna 13 and a second WIFI antenna 14, and the GPS antenna may include a first GPS antenna 15 and a second GPS antenna 16.

The processor 3 determines two target antennas to be optimized according to the user usage information acquired by an application in the terminal and sensor data in the terminal. The user usage information includes information such as on-off state information of WIFI, on-off state information of Bluetooth, and a communication scheme, a frequency band and an antenna address flag bit acquired by a modem side.

As an implementation, referring to FIG. 2, the isolation degree control module 2 includes an annular switch 21 connected to the processor 3, and each connection port of the annular switch 21 is connected to one of the plurality of antennas through an adjustable filter circuit 22 connected to the processor 3.

In one embodiment, the processor 3 is configured to, when at least one of the two target antennas is not a predetermined type of antenna, control the annular switch 21 to conduct a connection between an adjustable filter circuit 22 corresponding to one antenna (e.g., a first target antenna) of the two target antennas and an adjustable filter circuit 22 corresponding to the other antenna (e.g., a second target antenna) of the two target antennas, and control the adjustable filter circuit 22 corresponding to one antenna (e.g., the first target antenna) of the two target antennas to adjust its current operating frequency band to an operating frequency band corresponding to the other antenna (e.g., the second target antenna) of the two target antennas.

Specifically, the adjustable filter circuit 22 in FIGS. 2 and 3 is a low pass (LC) filter circuit. Through the LC filter circuit, an optimization of different-frequency isolation degree may be realized by filtering.

In particular, the predetermined type of antenna is referred to as the main antenna. When at least one of the two target antennas is not the predetermined type of antenna, the optimization of different-frequency isolation degree between the two target antennas needs to be performed. The above operation may be performed by the annular switch 21 so that a connection between the two target antennas may be conducted. In addition, by enabling the adjustable filter circuit 22 corresponding to each of the two target antennas to adjust its current operating frequency band to an operating frequency band corresponding to the other one of the two target antennas, the isolation degree between the two target antennas may be optimized.

By providing the annular switch 21, the optimization of isolation degree between different target antennas is realized.

The optimization of different-frequency isolation degree can also be achieved in another way. Referring to FIG. 3, the isolation degree control module 2 includes: a plurality of adjustable filter circuits 22 connected with the processor 3, and a first end of each adjustable filter circuit 22 is connected with one of the plurality of antennas, a second end of the each adjustable filter circuit 22 is connected with remaining antennas through a first radio frequency switch 23, and the adjustable filter circuits 22 and the first radio frequency switch 23 are connected with the processor 3.

In one embodiment, the processor 3 is configured to, when at least one of the two target antennas is not a predetermined type of antenna, control a first radio frequency switch 23 corresponding to one of the two target antennas to conduct a connection between an adjustable filter circuit 22 corresponding to one antenna (e.g., a first target antenna) of the two target antennas and the other antenna (e.g., a second target antenna) of the two target antennas, and control the adjustable filter circuit 22 corresponding to one antenna (e.g., the first target antenna) of the two target antennas to adjust its current operating frequency band to an operating frequency band corresponding to the other antenna (e.g., the second target antenna) of the two target antennas.

As shown in FIG. 3, an adjustable filter circuit 22 corresponding to each of the antennas is connected to an adjustable filter circuit 22 corresponding to another one of the antennas through a first radio frequency switch 23.

Similarly, the predetermined type of antenna is referred to as the main antenna, and when at least one of the two target antennas is not the predetermined type of antenna, the optimization of different-frequency isolation degree needs to be performed. Specifically, when performing the optimization of different-frequency isolation degree, the processor 3 controls the first radio frequency switch 23 to conduct the connection between the adjustable filter circuit 22 corresponding to the first target antenna and the adjustable filter circuit 22 corresponding to the second target antenna.

As shown in FIGS. 2 and 3, regardless of whether the isolation control module 2 achieves the optimization of different-frequency isolation through the annular switch 21 or the first radio frequency switch 23, the isolation control module 2 may further include a first power divider 24, a second power divider 25, and a radio frequency circuit 26.

One end of the first power divider 24 is connected to a first predetermined type of antenna among the plurality of antennas, and the other end of the first power divider 24 is connected to a first predetermined adjustable filter circuit 22. The first predetermined adjustable filter circuit 22 is an adjustable filter circuit 22 corresponding to the first predetermined type of antenna.

One end of the second power divider 25 is connected to a second predetermined type of antenna among the plurality of antennas, and the other end of the second power divider 25 is connected to a second predetermined adjustable filter circuit 22. The second predetermined adjustable filter circuit 22 is an adjustable filter circuit 22 corresponding to the second predetermined type of antenna.

The radio frequency circuit 26 is connected to the processor 3 and disposed between the first power divider 24 and the second power divider 25.

In one embodiment, the processor 3 is further configured to control the radio frequency circuit 26 to conduct a connection between the first power divider 24 and the second power divider 25 when both of the two target antennas are the predetermined type of antennas.

Specifically, the first predetermined type of antenna is the first main antenna 11, and the second predetermined type of antenna is the second main antenna 12; or the first predetermined type of antenna is the second main antenna 12 and the second predetermined type of antenna is the first main antenna 11.

When both of the two target antennas are the predetermined type of antennas, the processor 3 controls the radio frequency circuit 26 to conduct the connection between the first power divider 24 and the second power divider 25, so as to achieve an optimization of same-frequency isolation degree.

Specifically, as shown in FIGS. 2 and 3, the radio frequency circuit 26 includes a second radio frequency switch 261, a third radio frequency switch 262, and a coupler 263.

The second radio frequency switch 261 is connected to the first power divider 24 and the processor 3.

The third radio frequency switch 262 is connected to the second power divider 25 and the processor 3.

An input port of the coupler 263 is connected to the second radio frequency switch 261, and an isolation port of the coupler 263 is connected to the third radio frequency switch 262.

In one embodiment, the processor 3 is configured to, when both of the two target antennas are the predetermined type of antennas, control the second radio frequency switch 261 to conduct a connection with the input port of the coupler 263 and to control the third radio frequency switch 262 to conduct a connection with the isolation port of the coupler 263.

In order to be able to optimize the isolation degree of the entire frequency band, in embodiments of the present disclosure, as shown in FIGS. 2 and 3, the coupler 263 includes a plurality of couplers 263 connected in parallel with each other and disposed between the second radio frequency switch 261 and the third radio frequency switch 262, each of the couplers 263 corresponds to a frequency band range, and different couplers 263 correspond to different frequency band ranges.

In one embodiment, the processor 3 is configured to, when both of the two target antennas are the predetermined type of antennas, determine a target coupler according to a frequency band range in which an operating frequency band corresponding to one of the two target antennas is located, control the second radio frequency switch 261 to conduct a connection with an input port of the target coupler, and control the third radio frequency switch 262 to conduct a connection with an isolation port of the target coupler.

In one embodiment, as shown in FIGS. 2 and 3, the number of the plurality of couplers 263 is three, and among the three couplers 263, a frequency band range corresponding to a first coupler is greater than a frequency band range corresponding to a second coupler, and the frequency band range corresponding to the second coupler is greater than a frequency band range corresponding to a third coupler.

The operating frequency bands of different couplers 263 are set to be different, so that an optimization of the isolation degree of the main antenna with different frequency bands can be realized.

By the antenna system provided by the embodiments of the present disclosure, the isolation degree between two target antennas can be optimized. The isolation degree control module 2 can be made into standard devices according to requirements of different channels in countries and regions, which is convenient for designers to select the devices with different types, thereby greatly saving the design cycle and cost.

For example, it is assumed that a user enables a WIFI hotspot function of a mobile terminal for a laptop to be connected to the internet when 4G (B40 frequency band in the existing network) data service on the mobile terminal is turned on. In this case, the processor 3 may determine, according to reported data, that the isolation degree of e.g., the B40 frequency band between the first main antenna 11 and the second main antenna 12 needs to be improved, and meanwhile, the isolation degree between the second main antenna 12 and the first WIFI antenna 13 needs to be improved. At this time, the processor 3 controls the second radio frequency switch 261 and the third radio frequency switch 262 to be respectively conducted with one coupler corresponding to the B40 frequency band, so that the second radio frequency switch 261 and the third radio frequency switch 262 are conducted with each other, thereby optimizing the isolation degree between the first main antenna 11 and the second main antenna 12. Meanwhile, the processor 3 may conduct a connection between an adjustable filter circuit 22 corresponding to the second main antenna 12 and an adjustable filter circuit 22 corresponding to the first WIFI antenna 13 through the annular switch 21 in FIG. 2, and control the adjustable filter circuit 22 corresponding to the second main antenna 12 to switch its operating frequency band to an operating frequency band of the first WIFI antenna 13, and control an adjustable filter circuit 22 corresponding to the first WIFI antenna 13 to switch its operating frequency band to an operating frequency band of the second main antenna 12.

By controlling the circuit between the first main antenna 11 and the second main antenna 12, the isolation degree of the entire frequency band of B40 is improved. For example, an optimization of isolation degree corresponding to a frequency of 2390 MHz is most effective, the isolation degree corresponding to the frequency can be improved by about 11 dB, for example. By controlling the circuit between the first WIFI antenna 13 and the second main antenna 12, the isolation degree of the first WIFI antenna 13 may be improved (e.g., by about 15 dB).

According to another aspect of the embodiments of the present disclosure, a terminal is further provided by the embodiments of the present disclosure, which includes the above antenna system.

The terminal provided in the present disclosure may be a mobile phone, a tablet computer, a notebook computer and other terminals.

The foregoing is illustrative of the present disclosure and modifications and adaptations thereof may occur to those skilled in the art without departing from the principles of the present disclosure and should be considered as within the scope of the present disclosure.

What is claimed is:

1. An antenna system, comprising:

a plurality of antennas;

an isolation degree control module connected to the plurality of antennas, respectively; and a processor connected to the isolation degree control module, wherein the processor is configured to determine, among the plurality of antennas, two target antennas needing optimization control of isolation degree, and control, according to the two target antennas and operating frequency bands respectively corresponding to the two target antennas, the isolation degree control module to perform the optimization control of isolation degree between the two target antennas.

2. The antenna system of claim 1, wherein the isolation degree control module comprises:

an annular switch connected to the processor, wherein each connection port of the annular switch is connected to one of the plurality of antennas through an adjustable filter circuit connected to the processor, and wherein the processor is configured to, when at least one of the two target antennas is not a predetermined type of antenna, control the annular switch to conduct a connection between an adjustable filter circuit corresponding to a first target antenna of the two target antennas and an adjustable filter circuit corresponding to a second target antenna of the two target antennas, and control the adjustable filter circuit corresponding to the first target antenna of the two target antennas to adjust an operating frequency band of the adjustable filter circuit corresponding to the first target antenna to an operating frequency band corresponding to the second target antenna of the two target antennas.

3. The antenna system of claim 1, wherein the isolation degree control module comprises:

a plurality of adjustable filter circuits connected with the processor, wherein a first end of each adjustable filter circuit is connected with one of the plurality of antennas, a second end of the each adjustable filter circuit is connected with remaining antennas through a first radio frequency switch connected with the processor, and wherein the processor is configured to, when at least one of the two target antennas is not a predetermined type of antenna, control a first radio frequency switch corresponding to a first target antenna of the two target antennas to conduct a connection between an adjustable filter circuit corresponding to the first target antenna of the two target antennas and a second target antenna of the two target antennas, and control the adjustable filter circuit corresponding to the first target antenna of the two target antennas to adjust an operating frequency band of the adjustable filter circuit corresponding to the first target antenna to an operating frequency band corresponding to the second target antenna of the two target antennas.

4. The antenna system of claim 2, wherein the isolation degree control module further comprises:

a first power divider, one end of the first power divider is connected with a first predetermined type of antenna among the plurality of antennas, and the other end of the first power divider is connected with a first predetermined adjustable filter circuit, wherein the first predetermined adjustable filter circuit is an adjustable filter circuit corresponding to the first predetermined type of antenna;

a second power divider, one end of the second power divider is connected with a second predetermined type of antenna among the plurality of antennas, and the other end of the second power divider is connected with a second predetermined adjustable filter circuit, wherein the second predetermined adjustable filter circuit is an adjustable filter circuit corresponding to the second predetermined type of antenna; and a radio frequency circuit connected to the processor and disposed between the first power divider and the second power divider, wherein the processor is further configured to control, when both of the two target antennas are the predetermined type of antennas, the radio frequency circuit to conduct a connection between the first power divider and the second power divider.

5. The antenna system of claim 4, wherein the radio frequency circuit comprises:

a second radio frequency switch connected with the first power divider and the processor;

a third radio frequency switch connected with the second power divider and the processor; and a coupler, wherein an input port of the coupler is connected with the second radio frequency switch, and an isolation port of the coupler is connected with the third radio frequency switch, and wherein the processor is further configured to, when both of the two target antennas are the predetermined type of antennas, control the second radio frequency switch to conduct a connection with the input port of the coupler, and control the third radio frequency switch to conduct a connection with the isolation port of the coupler.

6. The antenna system of claim 5, wherein the coupler comprises:

a plurality of couplers connected in parallel with each other and disposed between the second radio frequency switch and the third radio frequency switch, each of the plurality of couplers corresponds to a frequency band range, and different couplers correspond to different frequency band ranges, and wherein the processor is further configured to, when both of the two target antennas are the predetermined type of antennas, determine a target coupler according to a frequency band range in which an operating frequency band corresponding to one of the two target antennas is located, control the second radio frequency switch to conduct a connection with an input port of the target coupler, and control the third radio frequency switch to conduct a connection with an isolation port of the target coupler.

7. The antenna system of claim 6, wherein the plurality of couplers comprise three couplers, a frequency band range corresponding to a first coupler of the three couplers is greater than a frequency band range corresponding to a second coupler of the three couplers, and the frequency band range corresponding to the second coupler is greater than a frequency band range corresponding to a third coupler of the three couplers.

8. The antenna system of claim 1, wherein the plurality of antennas comprises a main antenna, a wireless fidelity (WIFI) antenna and a Global Positioning System (GPS) antenna.

9. The antenna system of claim 2, wherein the adjustable filter circuit is a low pass LC filter circuit.

10. The antenna system of claim 2, wherein the predetermined type of antenna is a main antenna.

11. A terminal comprising an antenna system, wherein the antenna system comprises:

a plurality of antennas;

an isolation degree control module connected to the plurality of antennas, respectively; and a processor connected to the isolation degree control module, wherein the processor is configured to determine, among the plurality of antennas, two target antennas needing optimization control of isolation degree, and control, according to the two target antennas and operating frequency bands respectively corresponding to the two target antennas, the isolation degree control module to perform the optimization control of isolation degree between the two target antennas.

12. The antenna system of claim 3, wherein the isolation degree control module further comprises:

a first power divider, one end of the first power divider is connected with a first predetermined type of antenna among the plurality of antennas, and the other end of the first power divider is connected with a first predetermined adjustable filter circuit, wherein the first predetermined adjustable filter circuit is an adjustable filter circuit corresponding to the first predetermined type of antenna;

a second power divider, one end of the second power divider is connected with a second predetermined type of antenna among the plurality of antennas, and the other end of the second power divider is connected with a second predetermined adjustable filter circuit, wherein the second predetermined adjustable filter circuit is an adjustable filter circuit corresponding to the second predetermined type of antenna; and a radio frequency circuit connected to the processor and disposed between the first power divider and the second power divider, wherein the processor is further configured to control, when both of the two target antennas are the predetermined type of antennas, the radio frequency circuit to conduct a connection between the first power divider and the second power divider.

13. The antenna system of claim 12, wherein the radio frequency circuit comprises:

a second radio frequency switch connected with the first power divider and the processor;

a third radio frequency switch connected with the second power divider and the processor; and a coupler, wherein an input port of the coupler is connected with the second radio frequency switch, and an isolation port of the coupler is connected with the third radio frequency switch, and wherein the processor is further configured to, when both of the two target antennas are the predetermined type of antennas, control the second radio frequency switch to conduct a connection with the input port of the coupler, and control the third radio frequency switch to conduct a connection with the isolation port of the coupler.

14. The antenna system of claim 13, wherein the coupler comprises:

a plurality of couplers connected in parallel with each other and disposed between the second radio frequency switch and the third radio frequency switch, each of the plurality of couplers corresponds to a frequency band range, and different couplers correspond to different frequency band ranges, and wherein the processor is further configured to, when both of the two target antennas are the predetermined type of antennas, determine a target coupler according to a frequency band range in which an operating frequency band corresponding to one of the two target antennas is located, control the second radio frequency switch to conduct a connection with an input port of the target coupler, and control the third radio frequency switch to conduct a connection with an isolation port of the target coupler.

15. The antenna system of claim 14, wherein the plurality of couplers comprise three couplers, a frequency band range corresponding to a first coupler of the three couplers is greater than a frequency band range corresponding to a second coupler of the three couplers, and the frequency band range corresponding to the second coupler is greater than a frequency band range corresponding to a third coupler of the three couplers.

16. The antenna system of claim 3, wherein the adjustable filter circuit is a low pass LC filter circuit.

17. The terminal of claim 11, wherein the isolation degree control module comprises:

an annular switch connected to the processor, wherein each connection port of the annular switch is connected to one of the plurality of antennas through an adjustable filter circuit connected to the processor, and wherein the processor is configured to, when at least one of the two target antennas is not a predetermined type of antenna, control the annular switch to conduct a connection between an adjustable filter circuit corresponding to a first target antenna of the two target antennas and an adjustable filter circuit corresponding to a second target antenna of the two target antennas, and control the adjustable filter circuit corresponding to the first target antenna of the two target antennas to adjust an operating frequency band of the adjustable filter circuit corresponding to the first target antenna to an operating frequency band corresponding to the second target antenna of the two target antennas.

18. The terminal of claim 11, wherein the isolation degree control module comprises:

a plurality of adjustable filter circuits connected with the processor, wherein a first end of each adjustable filter circuit is connected with one of the plurality of antennas, a second end of the each adjustable filter circuit is connected with remaining antennas through a first radio frequency switch connected with the processor, and wherein the processor is configured to, when at least one of the two target antennas is not a predetermined type of antenna, control a first radio frequency switch corresponding to a first target antenna of the two target antennas to conduct a connection between an adjustable filter circuit corresponding to the first target antenna of the two target antennas and a second target antenna of the two target antennas, and control the adjustable filter circuit corresponding to the first target antenna of the two target antennas to adjust an operating frequency band of the adjustable filter circuit corresponding to the first target antenna to an operating frequency band corresponding to the second target antenna of the two target antennas.

19. The terminal of claim 17, wherein the isolation degree control module further comprises:

a first power divider, one end of the first power divider is connected with a first predetermined type of antenna among the plurality of antennas, and the other end of the first power divider is connected with a first predetermined adjustable filter circuit, wherein the first predetermined adjustable filter circuit is an adjustable filter circuit corresponding to the first predetermined type of antenna;

a second power divider, one end of the second power divider is connected with a second predetermined type of antenna among the plurality of antennas, and the other end of the second power divider is connected with a second predetermined adjustable filter circuit, wherein the second predetermined adjustable filter circuit is an adjustable filter circuit corresponding to the second predetermined type of antenna; and a radio frequency circuit connected to the processor and disposed between the first power divider and the second power divider, wherein the processor is further configured to control, when both of the two target antennas are the predetermined type of antennas, the radio frequency circuit to conduct a connection between the first power divider and the second power divider.

20. The terminal of claim 18, wherein the isolation degree control module further comprises:

a first power divider, one end of the first power divider is connected with a first predetermined type of antenna among the plurality of antennas, and the other end of the first power divider is connected with a first predetermined adjustable filter circuit, wherein the first predetermined adjustable filter circuit is an adjustable filter circuit corresponding to the first predetermined type of antenna;

a second power divider, one end of the second power divider is connected with a second predetermined type of antenna among the plurality of antennas, and the other end of the second power divider is connected with a second predetermined adjustable filter circuit, wherein the second predetermined adjustable filter circuit is an adjustable filter circuit corresponding to the second predetermined type of antenna; and a radio frequency circuit connected to the processor and disposed between the first power divider and the second power divider, wherein the processor is further configured to control, when both of the two target antennas are the predetermined type of antennas, the radio frequency circuit to conduct a connection between the first power divider and the second power divider.

* * * * *